US005170655A

United States Patent [19]

Lee

[11] Patent Number: 5,170,655

[45] Date of Patent: Dec. 15, 1992

[54] METHOD FOR FORMING HOLLOW ARTICLES

[75] Inventor: Yuan-Ho Lee, Tainan Hsien, Taiwan

[73] Assignee: San Shine Hardware Works Co., Ltd., Taiwan

[21] Appl. No.: 761,636

[22] Filed: Sep. 18, 1991

[51] Int. Cl.[5] ..... B21D 53/24

[52] U.S. Cl. ..... 72/332; 72/358; 470/25; 470/89

[58] Field of Search ..... 10/76 R, 76 T, 86 R, 10/86 F, 85, 72 R; 72/334, 333, 332, 329, 355.4, 355.2, 354.6, 358, 359; 470/26, 25, 89

[56] References Cited

U.S. PATENT DOCUMENTS 3,247,534 4/1966 McClellan ..... 72/359
3,267,500 8/1966 McClellan ..... 10/76 R

FOREIGN PATENT DOCUMENTS 148433 11/1981 Japan ..... 72/358
75241 5/1982 Japan ..... 72/358
861996 3/1961 United Kingdom ..... 10/76 R

*Primary Examiner*—Daniel C. Crane
*Attorney, Agent, or Firm*—Ladas & Parry

[57] ABSTRACT

The method includes a step of compressing a portion of a cylindrical stock into a third section of a cavity of a die. The cavity of the die includes a first section having a polygonal internal surface, a second section being narrower than the first section and having a first circle in cross section with a diameter substantially equal to the diameter of the stock which is fed in the second section and a third section between the first and second section. The third section has a second circle in cross section with a diameter gradually decreasing from the first section towards the second section.

2 Claims, 7 Drawing Sheets

METHOD FOR FORMING HOLLOW ARTICLES

BACKGROUND OF THE INVENTION

1. FIELD OF INVENTION

This invention relates to a method of forming a hollow article, more particularly to a new method for forming a hollow article, such as a nut blank, which method comprises fewer steps than the prior art method by using a die of new design.

2. DESCRIPTION OF THE RELATED ART

It has been an intention of every inventor to reduce the steps of making a certain article so as to cut down the cost of manufacturing and simultaneously increase the amount of production. So far, the cold extrusion method is widely used to form a hollow article, such as a nut blank.

FIGS. 1 to 4 show a conventional method of forming a nut blank by cold extrusion. The method comprises: (a) cutting a predetermined length of stock (A3) from a long cylindrical stock (A2) by a shear means (A1); (b) conveying said predetermined length of stock (A3) to a cavity confined by two die elements, one of which being stationary and the other one being movable between a closed position in which the stock is securely clamped and an open position in which the stock is free for feeding and being punched in said die (FIGS. 2 and 3 respectively illustrate the predetermined length of stock (A3) being punched by two rods); (c) moving a punch (A5) towards the predetermined length of stock (A3) into the cavity of the die and extruding a certain portion of the predetermined length of stock (A6) from the cavity of the die, thereby obtaining a nut having a blind bore therethrough and simultaneously ejecting a scrap from the die.

In the above-mentioned method, the ejected scrap of the stock is wasted, resulting in the increase of the cost of production.

There already exist a method of forming a nut blank without scrap entitled as U.S. Pat. No. 3,267,500. FIGS. 5(A) to 5(E) illustrate the steps of making a nut blank having a blind bore according to said U.S. Patent. As illustrated, the method includes the steps comprising: (1) moving a free end of a cylindrical stock (B1) deeper into an open die (B2) having a cavity including a first section with polygonal internal wall surfaces (B11) and a second section having a first circle in cross section with a diameter substantially equal to the diameter of the cylindrical stock (B1) fed into the open die (B2) by a flange of a sleeve member (B3) while a punch (B4) moves towards the free end of the cylindrical stock (B1); (2) extruding a certain amount of the cylindrical stock (B1) towards the opening of the open die (B2) from between an exterior of the punch (B4) and an internal wall of the open die (B2), piercing a blind bore (B12) within the cylindrical stock (B1) by the punch (B4) while the sleeve member (B3) moves away from the die; (3) moving a shear means with a receiving space (B5) aligned with the cavity of the open die; (4) conveying of a predetermined length of the extruded section of the cylindrical stock into the receiving space (B5) of the shear means; (5) inserting a stock gauge (B6) of the shear means into the blind bore (B12) of the predetermined length of the extruded section in order to hold it in a position; (6) cutting off the predetermined length of the extruded section (B11) while the shear means moves away from the open die (B2).

The above-mentioned method, though it can produce a nut blank without scrap and thus can cut down the cost of manufacturing, still has a few remaining setbacks:

(1) This method includes, first of all, a step of pushing the extruded section of the stock fully back into the cavity of the open die by the sleeve member. Then the sleeve member retracts back to its initial position before the punch moves towards the stock. In order to achieve the pushing and the retracting operation, the apparatus is installed with a more complicated machinery than necessary.

(2) The first section of the cavity of the die that has polygonal internal wall surfaces, is constructed longer than the desired length of a nut blank to be produced in order to obtain said desired length of nut blank. To construct a die with such a cavity costs more than the cost of construction of a die with a shorter cavity of such type.

(3) A clearance is formed between the exterior of the stock, having a circle in cross section, and the polygonal internal surfaces of the cavity of the die. This clearance can not provide full stability of the stock during the punching operation.

SUMMARY OF THE INVENTION

It is therefore the main object of the present invention to provide a new method for forming a hollow article, such as a nut blank, which does not have the above-mentioned drawbacks.

Another object of the present invention is to provide a new method which has fewer steps when compared to prior methods.

Accordingly, a method for forming a hollow article from a cylindrical stock in a die having a cavity including a first section with a first polygonal internal surface, a second section being narrower than said first section and having a circle in cross section with a diameter substantially equal to the diameter of said cylindrical stock which is fed in said second section and a third section between said first and second section, said third section having a second polygonal internal surface with a cross sectional length which is gradually decreasing from said first section towards said second section, said method comprising the steps of:

(1) feeding said cylindrical stock having a free end to be flushed with an open end of said die;

(2) moving a punch towards said free end of said stock while said stock is clamped in said cavity of said die, extruding a portion of said stock towards said opening of said die between an exterior of said punch and an internal wall of said die while compressing another portion of said stock into said third section of said cavity thereby piercing a blind bore through said punched stock;

(3) retracting said punch from said blind bore of said punched stock and simultaneously moving a shear means having a receiving space to be aligned with said cavity of said die and receiving a predetermined length of said extruded section of said punched stock which is conveyed into said receiving space of said shear means;

(4) holding said predetermined length of said extruded section of said punched stock by a stock gauge of said shear means and cutting off said predetermined length of said extruded section of said punched stock while said shear means moves away from said die.

BRIEF DESCRIPTION OF THE DRAWINGS

Other features and advantages of the invention will become more apparent in the following detailed description, including drawings, all of which show a non-limiting form of the invention, and of which FIGS. 1 to 4 respectively illustrate a conventional method comprising the steps of making a hollow article.

DETAILED DESCRIPTION OF THE PREFERRED EMBODIMENT

According to the present invention, the object is to provide a new method for making a nut blank by using a die having a cavity with a new design including a first section with polygonal internal surfaces shorter than that disclosed in U.S. Pat. No. 3,267,500. The length of the first section of the die used in the present invention is substantially equal to the length of a desired nut to be produced accordingly.

Figure 1:
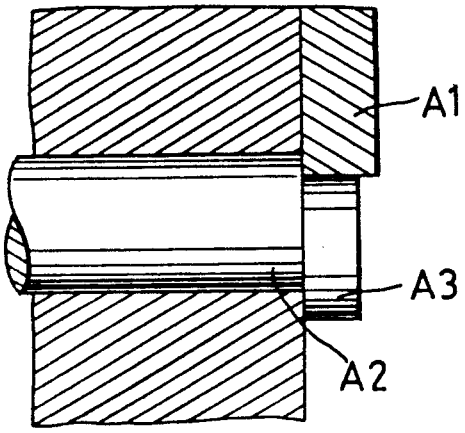
FIG. 1 (PRIOR ART)
Figure 2:
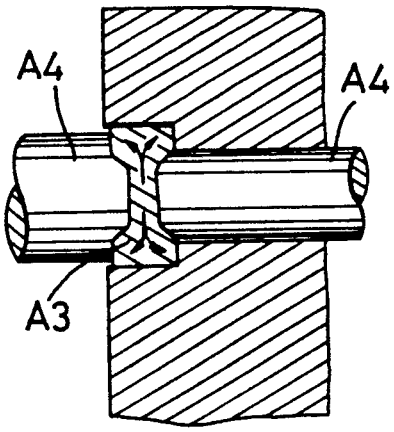
FIG. 2 (PRIOR ART)
Figure 3:
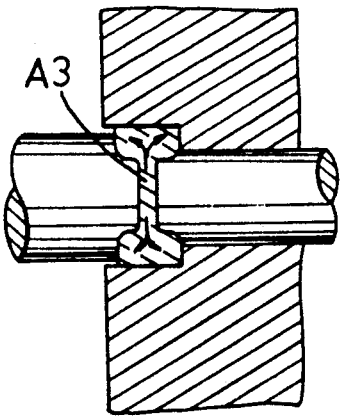
FIG. 3 (PRIOR ART)
Figure 4:
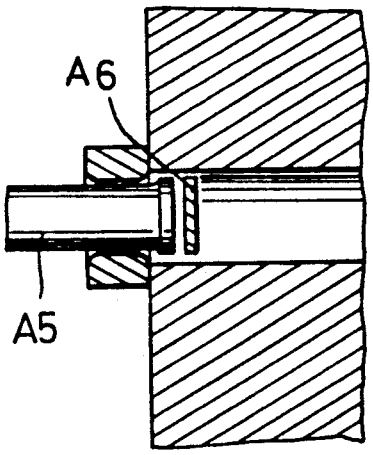
FIG. 4 (PRIOR ART)
Figure 5C:
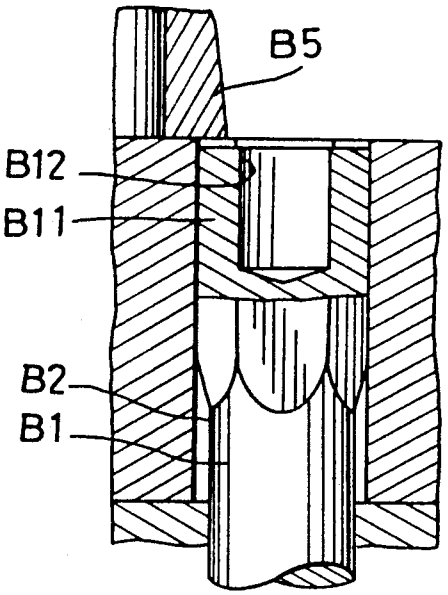
FIG. 5C (PRIOR ART)
FIGS. 5(A) to 5(E) respectively illustrates the method disclosed in U.S. Pat. No. 3,267,500 including the steps of making a hollow article.
Figure 5B:
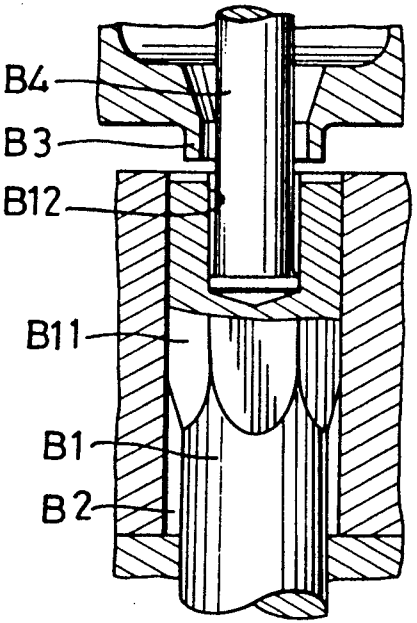
FIG. 5B (PRIOR ART)
Figure 5A:
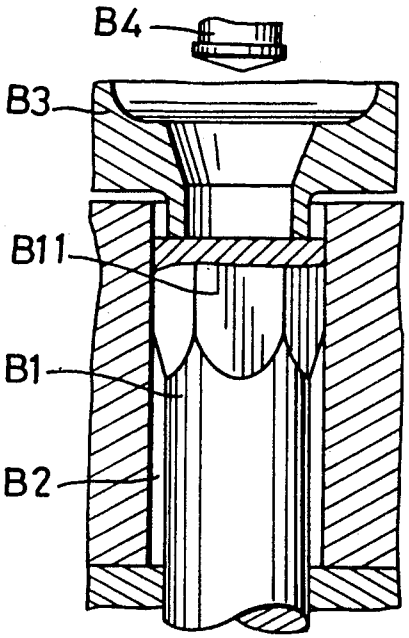
FIG. 5A (PRIOR ART)
Figure 5E:
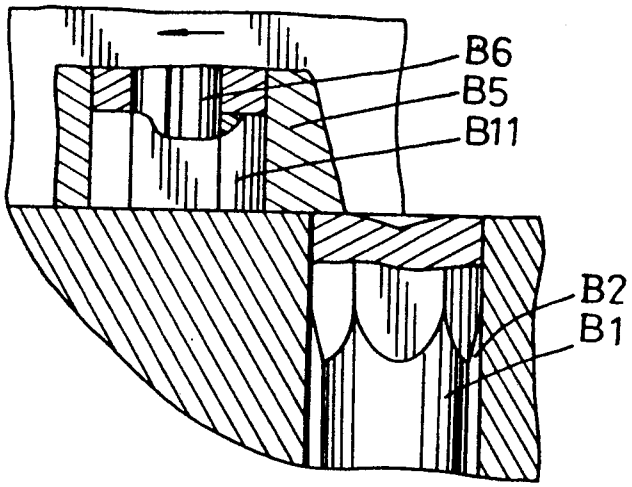
FIG. 5E (PRIOR ART)
Figure 5D:
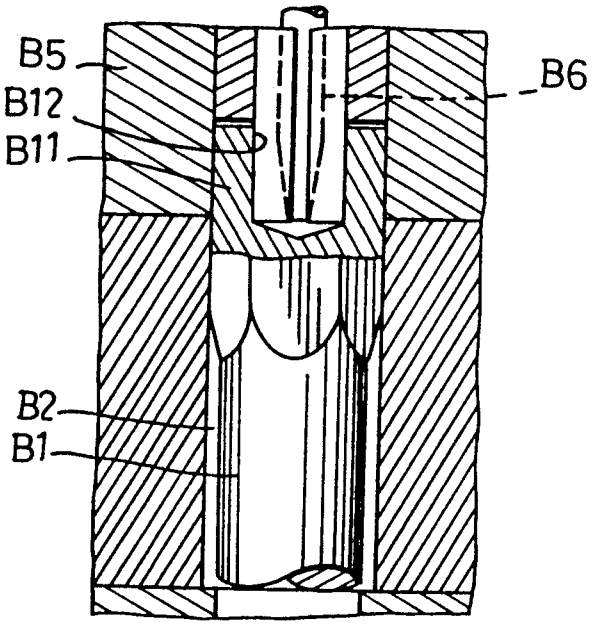
FIG. 5D (PRIOR ART)
Figure 6:
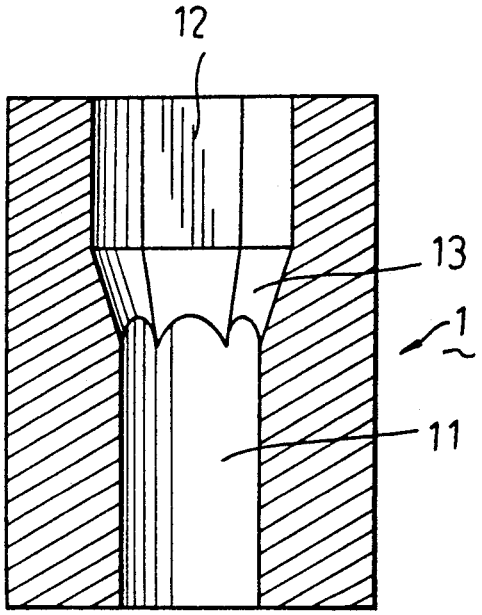
FIG. 6 is cross section view of a die used in the production of a nut blank according to the method of the present invention.

Referring to FIG. 6, the cavity of the die (1) according to the present invention includes a first section (12) having a length with a polygonal internal surface substantially equal to the length of a desired nut to be produced accordingly, a second section (11) that has a circle in cross section with a diameter substantially equal to the diameter of a stock to be clamped in the second section (11) and a third section (13) formed between the first and second sections. The third section (13) has a polygonal internal surface with a cross sectional length which is gradually decreasing from the first section (12) towards the second section (11).

It is because of this new design of the die, that the new method of the present invention does not include the step of pushing an extruded portion of the stock back into the cavity of the die as disclosed in the U.S. Pat. No. 3,267,500. In other words, the reduction of the number of steps in making a certain article can quicken the production.

Figure 7A:
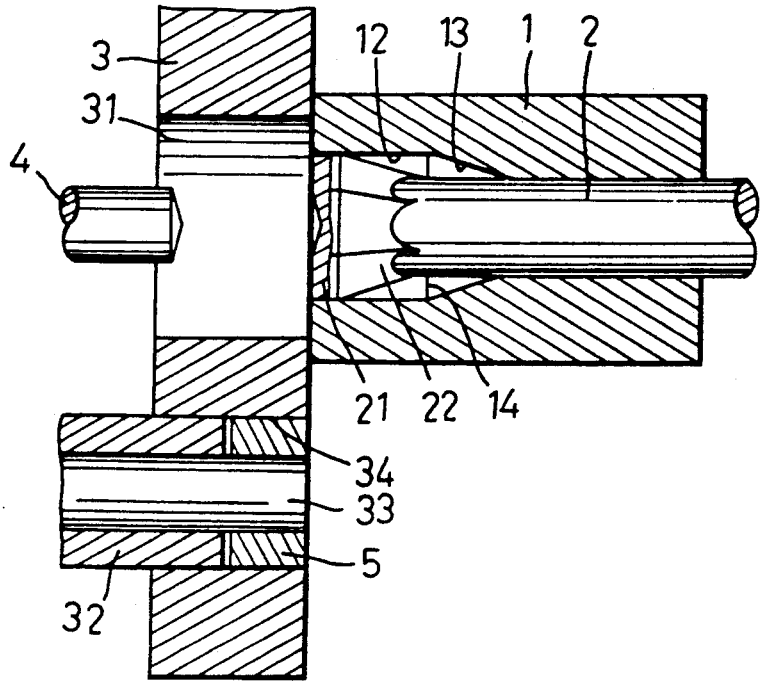
FIG. 7(A) shows a configuration in a first step of making a nut blank according to a method of the present invention.

The step of making a nut blank by the present invention includes:

11st. step: feeding a cylindrical stock (2) into the cavity (11) of the above-mentioned die (1). It is important to note at that condition, the free end (21) of the stock (2) is flushed with the cavity of the die (1) and has a conical recess at the intermediate portion thereof. The exterior surface of a lower portion of the cylindrical stock (2) in the first section (12) of the die already possesses a polygonal surface because of the former operation. The polygonal exterior surface of the upper portion of the stock (2) which is fed in the first section (12) of the die is in tight contact with the polygonal internal surface of the die. A clearance (14) still remains between an internal wall of the third section (13) of the die (1) and the exterior of the cylindrical stock (2). .Please see FIG. 7(A).

Figure 7B:
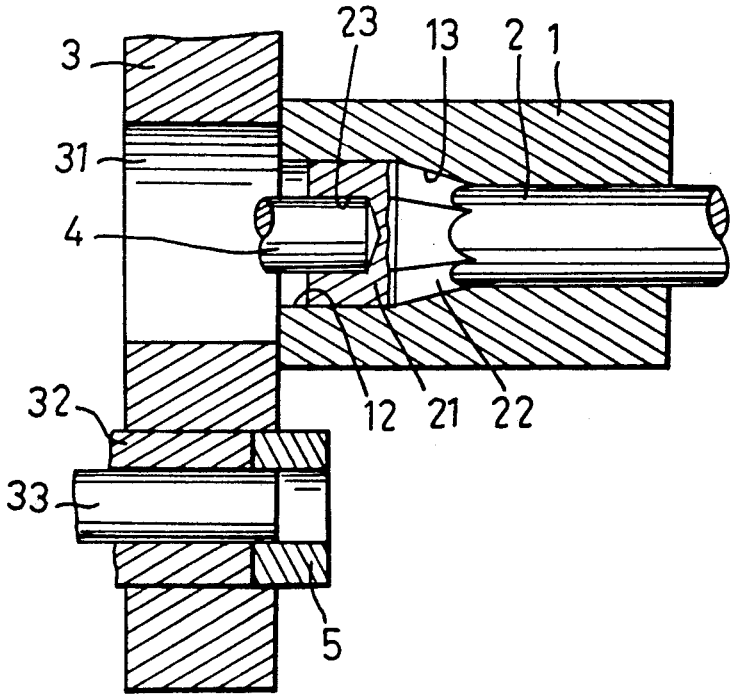
FIG. 7(B) shows a configuration in a second step of making a nut blank according to the method of the present invention.

2nd. step: moving a punch (4) towards the cylindrical stock while the stock is clamped in the cavity of the die (1). The punch (4) passes through an opening (31) of a shear means (3) during its movement towards the stock (2). Extrusion occurs towards the opening of the die (1) from between the exterior of the punch (4) and an internal wall of the die (1) simultaneously when a portion of the stock is compressed into the third section of the cavity by the forward movement of the punch, piercing a blind bore (23) through the extruded section of the punched stock. Please see in FIG. 7(B).

Figure 7C:
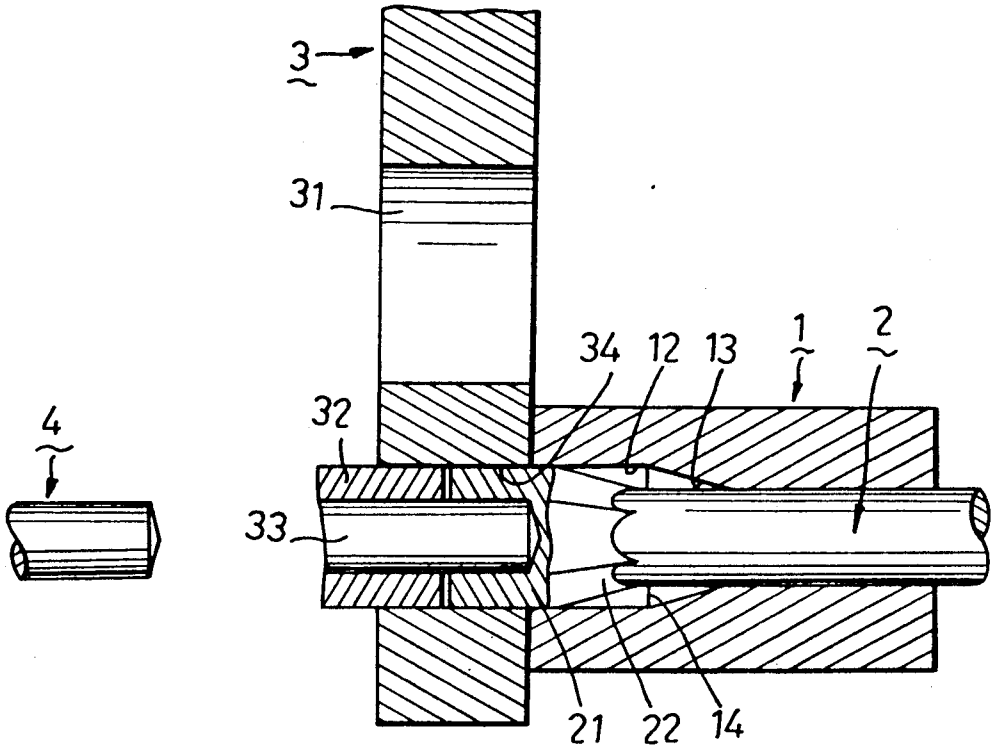
FIG. 7(C) shows a configuration in a third step making a nut blank according to the method of the present invention.

3rd. step: retracting the punch from the blind bore (23) of the extruded section of the punched stock while the shear means (3) is moved to be aligned with the cavity of the die (1). The shear means (3) includes a sleeve member (32) for ejecting the extruded section of the stock and a stock gauge (33) within the sleeve member (32) and a receiving space (34) adjacent to the sleeve member (32). At that time a predetermined length (5) of the extruded section of the punched stock is fed into the receiving space (34) of the shear means (3), as shown in FIG. 7(C).

Figure 7D:
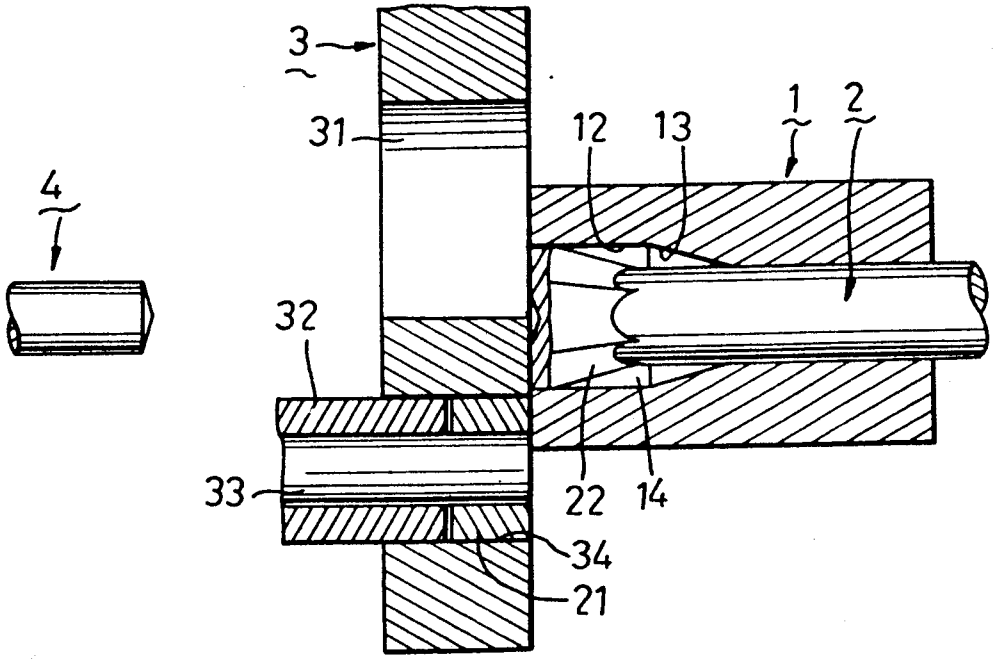
FIG. 7(D) shows a configuration in a fourth step of making a nut blank according to the method of the present invention.

4th. step: holding the predetermined length of the extruded section of the punched stock in the receiving space (34) by the stock gauge (33) of the shear means (3) and cutting off the predetermined length of the extruded section of the punched stock while the shear means moves away from the die and the ejection of the extruded section by the sleeve member takes place simultaneously. Please see in FIG. 7(D).

When comparing the present method with the prior art methods, its advantages are:

(1) The present method does not include the step of pushing the extruded section of the stock back into the cavity of the die as disclosed in the cited U.S. Patent, which correspondingly quickens the process of production of a nut blank.

(2) In the first step of the present invention, the polygonal exterior surface of the upper portion of the stock which is fed into the first section of the die, is in tight contact with the polygonal internal surface of the first section of the die while the lower portion of the cylindrical stock in the first section of the die cavity already possesses a polygonal exterior surface which cross section length is smaller than that of the first section due to a former cycle of the operation. Therefore, the prior step to make the lower portion of the stock to be so, as in the U.S. Patent is reduced. This correspondingly quicken the mass production of the nut blank.

(3) Since the third section of the cavity already has a polygonal internal surface, the stock that has a circle in cross section in the third section of the die, is made to have a polygonal exterior surface during the following forward movement of the punch. Only then, the stock can be punched in the first section of the die to provide a fine and sharp exterior surface.

(4) Only a lesser step is needed to produce a nut blank, thus the apparatus of the present invention does not involve as much complexity as in the prior art apparatus. Lesser complexity means lesser damage of the apparatus which in the long run reduces the cost of production.

It is also important to note that the cost of constructing such a die cost less than the prior art ones.

With the invention thus explained, it is obvious to those skilled in the art that several modifications and variations can be made without departing from the scope and spirit of the present invention. It is therefore intended that this invention be limited only as in the appended claims.

I claim:

1. A method for forming a hollow article from a cylindrical stock in a die having a cavity including a first section with a first polygonal internal surface, a second section being narrower than said first section and having a circular cross section with a diameter substantially equal to the diameter of said cylindrical stock which is fed into said second section and a third section between said first and second section, said third section having a second polygonal internal surface with a cross sectional length which is gradually decreasing from said first section towards said second section, said method comprising the steps of:

(1) feeding said cylindrical stock from said first section of said die into said cavity so that a free end of the stock is positioned flush with an open end of said die said first section having a length defined by the distance between the open end of said die and the third section;

(2) moving a punch towards said free end of said stock while said stock is clamped in said cavity and engaged by said second portion of said die, extruding by said punch a portion of said stock towards the opening of said first section of said die between an exterior of said punch and an internal wall of said die while compressing another portion of said stock into and against said third section of said cavity thereby piercing a blind bore through said punched stock and forming said stock with an exterior configuration said first and third section of said die;

(3) retracting said punch from said blind bore of said punched stock and simultaneously moving a shear means having a receiving space into alignment with said cavity of said die and conveying a predetermined length of said extruded section of said punched stock into said receiving space of said shear means, said predetermined length being less than the vertical length of said first section of said cavity of said die, and holding said predetermined length of said extruded section of said punched stock by a stock gauge of said shear means and cutting off said predetermined length of said extruded section of said punched stock while said shear means moves away from said die.

2. A process as claimed in claim 1, wherein said shear means further comprises a sleeve member which enters into said receiving space to eject said predetermined length of said extruded section of said punched stock from within said receiving space.

* * * * *